US009696027B2

(12) United States Patent
Hargrove et al.

(10) Patent No.: US 9,696,027 B2
(45) Date of Patent: Jul. 4, 2017

(54) ECONOMIZER WATER RECIRCULATION SYSTEM FOR BOILER EXIT GAS TEMPERATURE CONTROL IN SUPERCRITICAL PRESSURE BOILERS

(75) Inventors: Michael J. Hargrove, Windsor Locks, CT (US); Gary J. Navitsky, New Hartford, CT (US); Jason J. Wailgum, Worcester, MA (US); Bernard H. Walsh, Feeding Hills, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 669 days.

(21) Appl. No.: 12/731,539

(22) Filed: Mar. 25, 2010

(65) Prior Publication Data

US 2011/0155347 A1 Jun. 30, 2011

Related U.S. Application Data

(60) Provisional application No. 61/290,752, filed on Dec. 29, 2009.

(51) Int. Cl.

| | |
|---|---|
| ***F28D 15/00*** | (2006.01) |
| ***F22B 3/08*** | (2006.01) |
| ***F22B 29/02*** | (2006.01) |
| ***F22B 35/06*** | (2006.01) |
| ***F22D 1/28*** | (2006.01) |

(52) U.S. Cl.

CPC ..... *F22B 3/08* (2013.01); *F22B 29/026* (2013.01); *F22B 35/06* (2013.01); *F22D 1/28* (2013.01)

(58) Field of Classification Search

USPC ..... 122/6 R, 479.2, 460, 466, 477, 483

See application file for complete search history.

(56) References Cited

U.S. PATENT DOCUMENTS 3,135,096 A * 6/1964 Schroedter ..... F01K 3/22 122/406.5
3,162,179 A * 12/1964 Strohmeyer, Jr. ..... 122/406.4
(Continued)

FOREIGN PATENT DOCUMENTS

CN 101636214 A 1/2010
WO 2011034726 A1 3/2011

OTHER PUBLICATIONS

The International Search Report and the Written Opinion of the International Searching Authority for PCT/US2010/057185 dated Jun. 29, 2012.

*Primary Examiner* — Alissa Tompkins
*Assistant Examiner* — Nathaniel Herzfeld
(74) *Attorney, Agent, or Firm* — GE Global Patent Operation; Stephen G. Midgley

(57) ABSTRACT

A fluid recirculation system includes an arrangement of a flow control valve located to receive a flow of fluid from an inlet. The system further comprises an economizer inlet mixing device located to receive the flow of hotter fluid from the arrangement of the flow control valve and from a cooler feedwater stream. An economizer inlet mixing device located upstream of an economizer in a supercritical pressure boiler includes a sparger assembly through which a flow of fluid from the waterwall outlet is received, an inlet through which a flow of fluid from a feed stream is received, and a wave breaker assembly through which an outlet stream from the economizer inlet mixing device is directed.

14 Claims, 3 Drawing Sheets

(56) References Cited

U.S. PATENT DOCUMENTS

| | | | | |
|---|---|---|---|---|
| 3,185,136 | A * | 5/1965 | Cozza | F22B 29/02 122/406.4 |
| 3,194,217 | A * | 7/1965 | Grabowski | F28G 9/00 122/379 |
| 3,370,573 | A * | 2/1968 | Hanzalek | F01K 3/22 122/406.5 |
| 4,241,585 | A | 12/1980 | Gorzegno | |
| 4,487,166 | A | 12/1984 | Haller et al. | |
| 5,048,466 | A * | 9/1991 | Rudd | F22B 29/12 122/406.4 |
| 6,088,418 | A * | 7/2000 | Martin | 376/283 |
| 6,093,310 | A * | 7/2000 | Swan | 208/113 |
| 6,595,163 | B2 * | 7/2003 | Dumaz et al. | 122/404 |
| 6,609,483 | B1 * | 8/2003 | Albrecht | F22B 37/008 122/166.2 |
| 6,637,380 | B2 * | 10/2003 | Li | 122/390 |
| 2002/0083903 | A1 * | 7/2002 | Liebig | 122/1 R |
| 2003/0159662 | A1 * | 8/2003 | Albrecht et al. | 122/468 |
| 2004/0011049 | A1 * | 1/2004 | Schwarzott | B01F 3/0865 60/772 |
| 2009/0148371 | A1 | 6/2009 | Reddy et al. | |
| 2010/0089061 | A1 * | 4/2010 | Banas et al. | 60/670 |

* cited by examiner

ECONOMIZER WATER RECIRCULATION SYSTEM FOR BOILER EXIT GAS TEMPERATURE CONTROL IN SUPERCRITICAL PRESSURE BOILERS

CROSS-REFERENCE TO RELATED APPLICATIONS

This application claims priority to U.S. Provisional Patent Application Ser. No. 61/290,752, filed Dec. 29, 2009, which is incorporated by reference herein in its entirety, and further claims priority to U.S. Provisional Patent Application Ser. No. 61/288,576, filed Dec. 21, 2009.

TECHNICAL FIELD

The disclosure herein is a general description of a system that can be applied to existing supercritical pressure boilers whereby a portion of the heated boiler waterwall outlet fluid is recirculated back to an inlet of an economizer. More particularly, the disclosure is directed to a fluid recirculation system for the purposes of maintaining higher exit gas temperatures at lower boiler loads, at an outlet of the economizer in a supercritical boiler and a method of operating the economizer recirculation system.

BACKGROUND

A boiler is typically a closed high-pressure system defined by many interconnected headers, pipes, and tubes and containing a fluid that can be heated under controlled conditions. As the fluid is heated to a certain temperature, the fluid absorbs energy. This fluid can then be used to provide work, or it can be used as a source of heat.

Fuel used to heat the fluid in the boiler is burned in a furnace portion of the boiler. In a boiler that employs water as the fluid contained therein, waterwalls are positioned around the furnace and contain tubes through which the fluid flows. The typically deaerated fluid is first fed to tubes of an economizer and then is fed to the tubes in the waterwalls. The economizer receives feedwater and makeup water, which replaces losses from the steam produced. The economizer absorbs heat from flue gases produced from the burning of fuel in the furnace and transfers the heat to the feedwater and the makeup water.

In a supercritical boiler, fluid from the economizer is converted to steam as it passes through the tubes in the waterwalls. The steam may be used directly in a process (to produce work or as a source of heat). If not used directly in a process, the steam may be passed to a superheater wherein the steam is heated further. The superheated steam increases the efficiency of a steam turbine to which it is supplied.

Typically, the temperature of the boiler flue gas leaving the economizer is lower when the boiler is operating at reduced steam flows. In instances when the boiler operates with a selective catalyst reduction (SCR) system at the flue gas exhaust, the reactiveness of the catalyst is dependent upon the flue gas temperature entering the catalyst reactor. Accordingly, a reduction in flue gas temperature below a threshold value results in the catalyst being less reactive.

SUMMARY

According to one aspect described herein, there is provided a fluid recirculation system in a boiler. The system comprises an arrangement of flow control valves located to receive a flow of fluid from an inlet of the system. The system further comprises an economizer inlet mixing device located to receive the flow of fluid from the arrangement of flow control valves and from a feedwater stream. In one embodiment, the feedwater stream is cooler in temperature relative to a temperature of the fluid from the arrangement of flow control valves. An outlet stream from the economizer inlet mixing device allows for a temperature of a flow of fluid entering an economizer to be controlled. Additionally, the temperature of the flue gas exiting the economizer is increased to and maintained at an optimum value.

According to another aspect herein, there is provided an economizer inlet mixing device located upstream of an economizer in a boiler. This device comprises a sparger assembly through which at least a portion of a flow of fluid to a superheater is received, an inlet through which a flow of fluid from a feed stream is received, an outlet strainer for the mixed fluid, and a wave breaker assembly through which an outlet stream from the economizer inlet mixing device is directed. The outlet stream comprises a combination of the flow of fluid through the sparger assembly and the flow of fluid from the feed water stream.

According to yet another aspect, a method of increasing a temperature of a flue gas exiting an economizer in a boiler includes receiving at least a portion of a flow of fluid from a fluid stream from a furnace to a superheater, combining at least a portion of the received flow of fluid with a feedwater stream, and directing the combined received flow of fluid and feedwater stream to an economizer. The temperature of the combined received flow of fluid and feedwater stream to the economizer is controlled to decrease heat absorption in the economizer, thereby increasing the temperature of the flue gas exiting the economizer and enabling a selective catalytic reactor through which the flue gas flows to operate at an optimum design temperature.

BRIEF DESCRIPTION OF THE DRAWINGS

Referring now to the Figures, which show exemplary embodiments, and wherein like elements are numbered alike.

DETAILED DESCRIPTION

Figure 1:
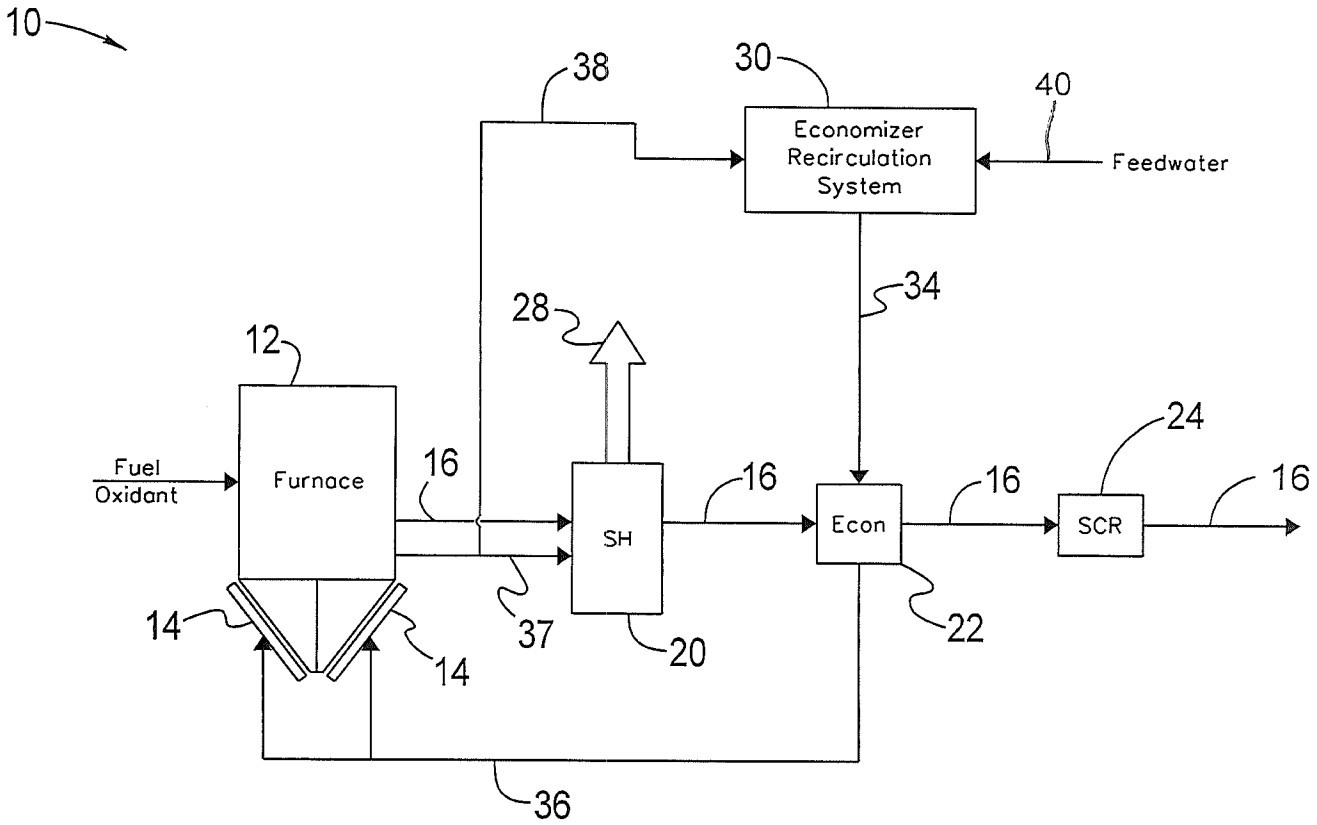
FIG. 1 is a schematic representation of a supercritical pressure boiler in which an economizer water recirculation system may be employed.

Referring to FIG. 1, one exemplary embodiment of a boiler, in which an economizer water recirculation system is employed, is designated generally by the reference number 10. In one embodiment, the boiler 10 is a supercritical pressure boiler. Fuel is combusted in the boiler 10, and chemical energy therein is converted into thermal energy and is used to heat a liquid within the boiler to produce a vapor that can be used to drive a turbine or the like. The liquid is hereinafter referred to as being water, and the vapor is hereinafter referred to as steam.

In the boiler 10, the fuel and an oxidant are introduced into a furnace 12 having waterwalls 14. Upon combustion of the fuel, a flue gas 16 is generated and is directed to a superheater 20, through an economizer 22, and into a selective catalytic reduction (SCR) system 24 (hereinafter "SCR 24").

To produce the steam, which is designated by the reference number 28, feedwater is fed to the economizer 22 via an economizer water recirculation system 30 (hereinafter "recirculation system 30"). A water stream 34 from the recirculation system 30 is directed to the economizer 22. Heat is transferred from the flue gas 16 to the water stream passing through the economizer. A water stream 36 from the economizer 22 then passes through the waterwalls 14 before being directed as a stream 37 to the superheater 20. A recirculation fluid flow 38 is taken from the stream 37 after passing through the waterwalls and is fed back to the recirculation system 30. In doing so, the temperature of the water entering the economizer 22 is increased in a controlled manner. This decreases the economizer heat absorption by reducing the temperature difference between the flue gas and the water in the economizer. The result is an increase in the temperature of the flue gas 16 exiting the economizer 22.

Figure 2:
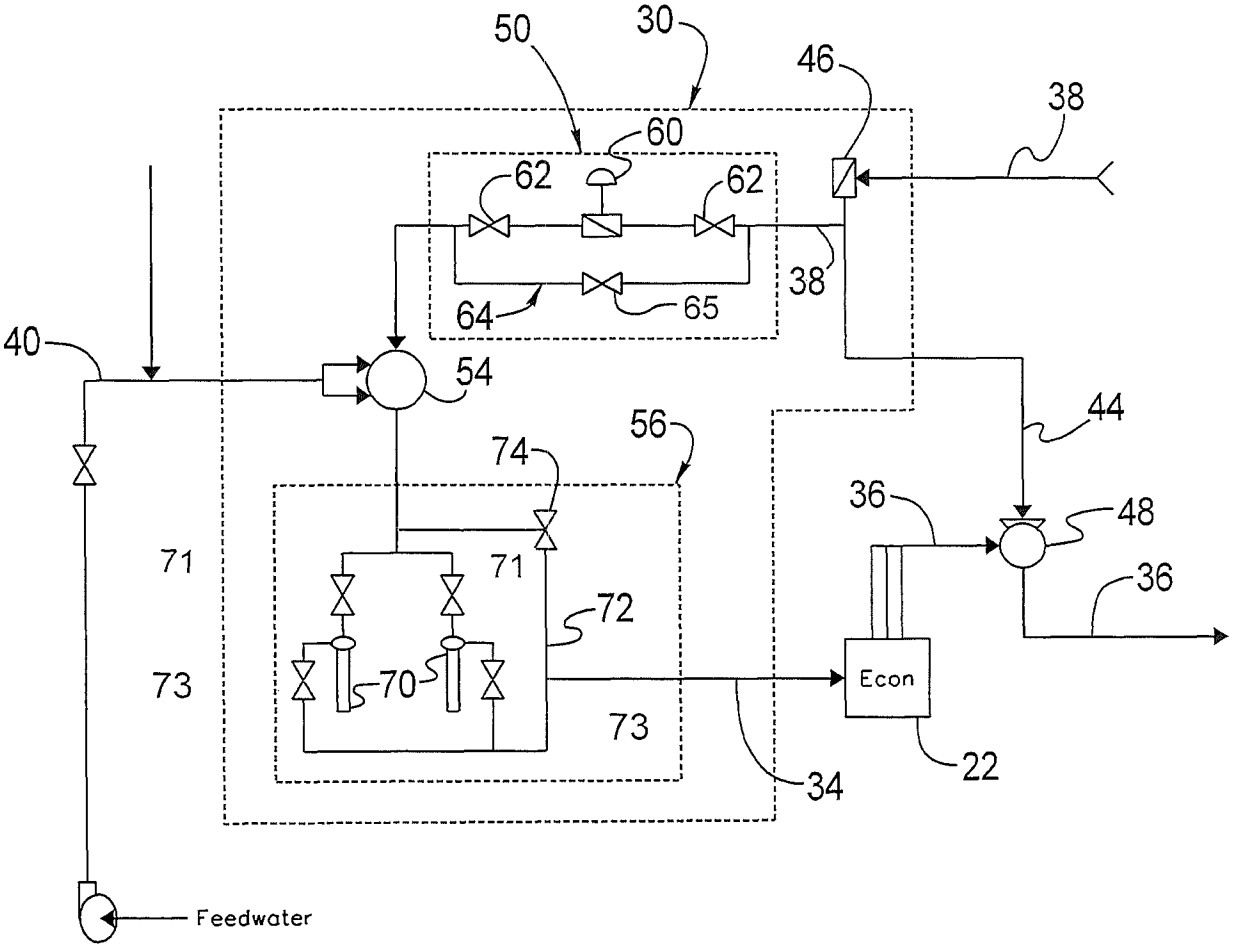
FIG. 2 is a schematic representation of the economizer water recirculation system and feed streams therefrom and thereto.

Referring now to FIG. 2, the recirculation system 30 receives two separate streams, namely, the feedwater stream 40 and the recirculation fluid flow 38. In receiving the feedwater stream 40, the feedwater stream is fed through a startup water stream, which is received either from the outlet of a startup valve that supplies the feedwater during conditions of low feedwater flow or from the main feedwater valve. The water stream 34 exiting the recirculation system 30 is directed to the economizer 22. As stated above, the water stream 36 then exits the economizer.

A minimal flow of fluid from a warming line 44 between check valve 46 and the boiler mixing chamber 48 keeps the piping at uniform temperatures.

As is shown, the recirculation system 30 comprises the recirculation check valve 46 through which the recirculation fluid flow 38 is received, a flow control valve arrangement 50 that receives the recirculation fluid flow 38, an economizer inlet mixing device 54 that receives feedwater flow and recirculation flow through the flow control valve arrangement 50, and a recirculation pump/valve arrangement 56 that receives an outlet fluid stream from the economizer inlet mixing device 54. The combined feedwater stream 40 and the startup stream are received into the recirculation system 30 via the economizer inlet mixing device 54

In the illustrated embodiment, the flow control valve arrangement 50 comprises a pneumatic- or motor-actuated temperature-controlled valve 60, which can be isolated using gate valves 62 located upstream and downstream thereof. The pneumatic- or motor-actuated temperature-controlled valve 60 and the adjacently positioned gate valves 62 can be bypassed via a bypass line 64 with a bypass globe valve 65.

The fluid flow through the flow control valve arrangement 50 is received into the economizer inlet mixing device 54.

The fluid flow from the economizer inlet mixing device 54 is received into the recirculation pump/valve arrangement 56, which comprises one or more recirculation pumps 70. Operation of the pump(s) 70 reduces the pressure of the fluid in the economizer inlet mixing device 54. The recirculation system 30 is not limited in this regard however, as the pressure in the economizer inlet mixing device 54 can be additionally reduced by locating additional pumps in series at the inlet of the economizer 22. In the recirculation pump/valve arrangement 56 shown, gate valves 71 isolate the flow of fluid into the pumps, and stop-check valves 73 prevent backflow through the pumps 70. The outlet stream of the pumps 70 is the fluid stream 34. A bypass line 72 may be used to direct all or a portion of the flow around the recirculation pump/valve arrangement 56. The bypass line 72 includes a bypass stop-check valve 74.

In combining the feedwater with the recirculated fluid from the flow control valve arrangement 50, the temperature of the fluid mixture entering the economizer 22 is controlled (increased). This decreases the economizer heat absorption by reducing the temperature difference between the flue gas and the water in the economizer 22. The result is an increase in the economizer exit gas temperature (flue gas 16). The recirculation system 30 thereby allows for maintaining a higher economizer exit gas temperature (i.e., the temperature at the economizer outlet) as compared to prior art boilers, at reduced boiler steam flows. By controlling the quantity of recirculation fluid flow 38, the gas temperatures entering the SCR 24 are increased during low load operation. This enables the SCR 24 to remain in service at lower loads. Moreover, the recirculation system 30 can be retrofit to existing supercritical boilers, thereby allowing for more predictable SCR inlet gas temperature stratification and less SCR mixing equipment as compared to prior art gas bypass systems.

Figure 3:
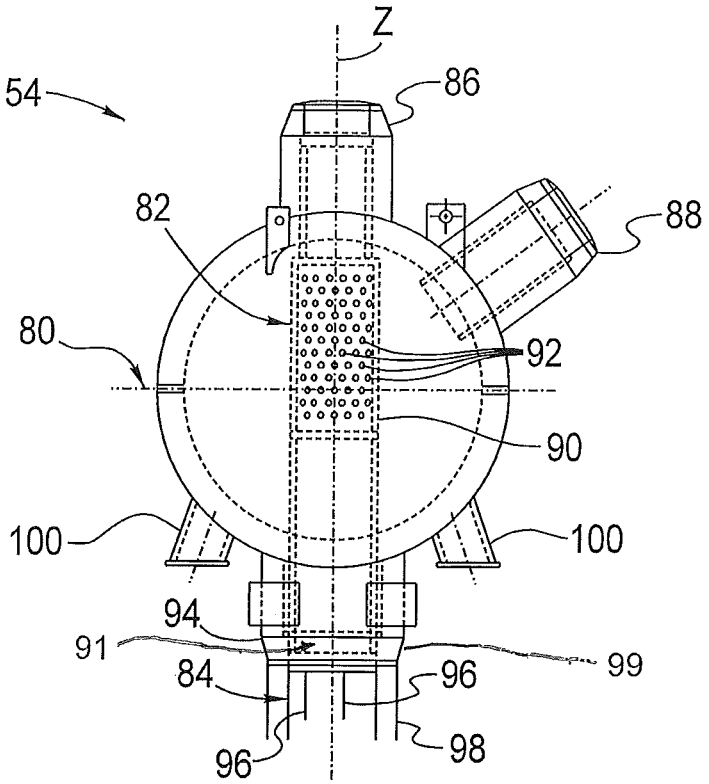
FIG. 3 is a front view of an economizer inlet mixing device for use with the economizer water recirculation system.
Figure 4:
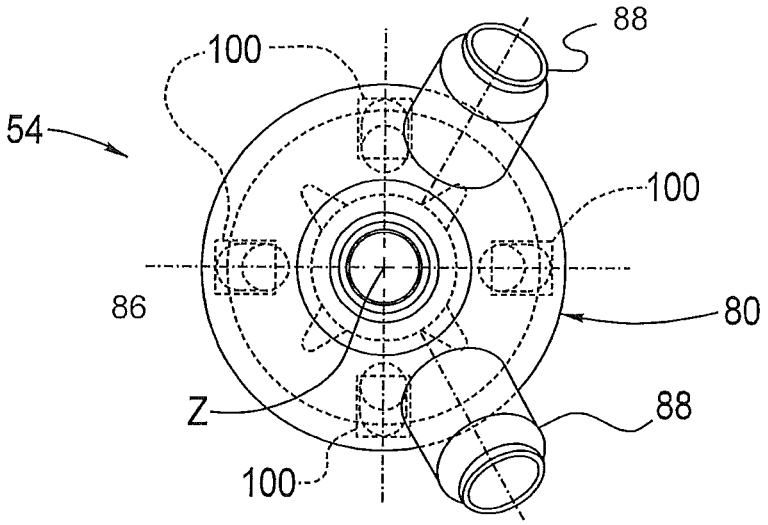
FIG. 4 is a top view of the economizer inlet mixing device of FIG. 3.

Referring now to FIGS. 3 and 4, the economizer inlet mixing device 54 comprises a housing 80 in which a sparger assembly 82 is mounted. The upper section of the sparger assembly 82 receives the recirculation fluid flow 38 from the flow control valve arrangement 50 through an inlet 86. Because the recirculation fluid flow 38 is from the stream 37 from the waterwalls 14 and the outer waterwalls to the superheater 20, the fluid in this stream is at very high temperature during operation of the boiler 10.

When directed into the sparger assembly 82, the recirculation fluid is sprayed or otherwise dispersed within the housing 80 to mix with the incoming feedwater. The sparger assembly comprises a cylindrical member 90 having a plurality of holes, slits, or other openings 92 therein. The pressure head of the flow through the inlet 86, which may be substantial, sparges the fluid from the inside of the cylindrical member 90 through the openings 92 to the area outside of the cylindrical member and enclosed by the inner wall of the housing 80.

The feedwater stream 40 (combined with the startup water stream) is also received into the housing 80 via two or more feedwater inlets 88.

The lower section of sparger assembly 82 is a pump-protection strainer 91 for the mixed fluid, which discharges into an outlet 94 comprising a downcomer nozzle 99 below which a wave breaker assembly 84 is mounted. The wave breaker assembly 84 comprises a plurality of baffles 96 longitudinally arranged in a conduit 98. The baffles 96 are sized and positioned to destroy any fluid-side propagation waves and to direct the flow from the housing 80 in lines of flow parallel to the direction in which the conduit 98 extends, thereby eliminating the potential for unstable vibrations caused by close proximity cavitation. From the wave breaker assembly 84, the fluid is directed to the recirculation pump/valve arrangement 56.

As can be seen in FIG. 3, support legs 100 are mounted on the outside of the housing 80 to allow the economizer inlet mixing device 54 to be constrained. Although four legs are shown as supporting the housing 80, it should be understood that any number of legs that can suitably constrain the housing can be employed. As can be seen in FIG. 4, the feedwater inlets 88 are offset from a central axis Z extending vertically through the housing 80 and are arranged such that flow streams through each intersect each other for optimum mixing. Wherein the feedwater inlets 88 are offset by less than ninety degrees from a central axis Z that extends through the economizer inlet mixing device 54.

By flowing the feedwater and the hot fluid from the flow control valve arrangement 50 through the sparger assembly and the wave breaker assembly of the economizer inlet mixing device 54, periodic vibrations due to a close proximity of pressure pockets collapsing and large fluid temperature differences, are prevented or at least minimized.

Although the present disclosure has been shown and described with respect to the detailed embodiments thereof, it will be understood by those of skill in the art that various changes may be made and equivalents may be substituted for elements thereof without departing from the scope of as described herein. In addition, modifications may be made to adapt a particular situation or material to the teachings of the invention without departing from the essential scope thereof. Therefore, it is intended that the present disclosure not be limited to the particular embodiments disclosed in the above description, but that the invention will include all embodiments falling within the scope of the appended claims.

What is claimed is:

1. A fluid recirculation system of a boiler, the fluid recirculation system comprising:

an economizer for transferring heat between a mixed water stream provided to a waterwall of a furnace and the flue gas exiting the furnace, the economizer configured to receive flue gas from a superheater and emit the flue gas into a selective catalyst reduction (SCR) system;

an arrangement of flow control valves located to receive a recirculation fluid stream, including steam, from the waterwall of the furnace;

a fluid stream path in direct fluid communication with the waterwall of the furnace and the superheater;

a recirculation flow path in fluid communication with the fluid stream path to provide the recirculation fluid stream to the arrangement of flow control valves;

an economizer inlet mixing device including an inlet to receive a feedwater stream, and a sparger assembly located within the economizer inlet mixing device to receive the recirculation fluid stream from the arrangement of flow control valves and the feedwater stream from the inlet, wherein the inlet is offset by less than ninety degrees from a central axis that extends through the economizer inlet mixing device defining an offset angle of the inlet;

an outlet to provide the mixed water stream to the economizer controlling a temperature of a flow of fluid entering the economizer; and a temperature of the flue gas is increased in the economizer to exit at an optimum value for operation of the SCR system at less than full load, with the outlet flow of fluid from the economizer recirculated to the waterwall;

wherein the sparger assembly and the offset angle of the inlet allow for optimum mixing of the recirculation fluid stream and the feedwater stream so that the temperature of the flow of fluid entering the economizer is precisely controlled to thereby control the temperature of the flue gas exiting the economizer to the optimum value to ensure catalyst reactiveness in the SCR system.

2. The fluid recirculation system of claim 1, further comprising a recirculation valve arrangement located at the outlet from the economizer inlet mixing device upstream of the economizer.

3. The fluid recirculation system of claim 2, further comprising a bypass line to direct at least a portion of a flow of fluid around the recirculation valve arrangement to the economizer.

4. The fluid recirculation system of claim 1, further comprising a check valve located upstream of the arrangement of flow control valves.

5. The fluid recirculation system of claim 1, wherein the arrangement of flow control valves comprises at least one of a pneumatic- and a motor-actuated temperature-controlled valve to control the amount of recirculation water stream to the economizer inlet mixing device in accordance to a desired temperature of the mixed water stream.

6. The fluid recirculation system of claim 5, wherein the arrangement of the flow control valves further comprises a bypass line located to allow a flow of water around the respective pneumatic- or motor-actuated temperature-controlled valve.

7. The fluid recirculation system of claim 1, wherein the economizer inlet mixing device comprises a sparger assembly disposed within the housing and a wave breaker assembly disposed at the outlet wherein the wave breaker assembly comprises a plurality of baffles.

8. The fluid recirculation system of claim 7, wherein within the economizer inlet mixing device is the sparger assembly comprising a cylindrical member having a plurality of openings located therein through which the recirculation fluid stream from the arrangement of the flow control valves is received.

9. The fluid recirculation system of claim 2 wherein the recirculation valve arrangement includes at least two valves.

10. An economizer inlet mixing device located upstream of an economizer in a supercritical pressure boiler having at least one waterwall disposed within a furnace to produce a recirculation fluid stream, the economizer inlet mixing device comprising:

a housing to mix a feedwater stream and the recirculation fluid stream, including steam, to provide a mixture water stream;

a first inlet to receive the recirculation fluid stream from the waterwall of the furnace;

a second inlet to receive the feedwater stream and offset by less than ninety degrees from a central axis that extends vertically through the housing, defining an offset angle of the inlet;

an outlet to provide the mixed water stream to an economizer;

a sparger assembly disposed in the housing through which at least a portion of the recirculation fluid stream from the waterwall passes through a plurality of holes to mix the recirculation fluid stream with the feedwater stream; and a wave breaker assembly disposed at the outlet and comprising a plurality of baffles through which is received the mixed water stream, wherein the plurality of baffles minimize fluid vibration and the mixed water stream comprises a combination of the flow of the recirculation fluid stream through the sparger assembly and the flow of the feedwater stream, with the mixed water stream being of a first temperature sufficient to raise a second temperature of a flue gas exiting the economizer to an optimum value for less than full load operation of a selective catalyst reduction (SCR) system located downstream of and in communication with the economizer wherein the offset angle of the inlet, the sparger assembly and the wave breaker assembly allow for optimum mixing of the recirculation fluid stream and the feedwater stream so that the first temperature of the mixed water stream entering the economizer can be precisely controlled to thereby control the second temperature of the flue gas exiting the economizer to the optimum value to ensure catalyst reactiveness in the SCR system.

11. The economizer inlet mixing device of claim 10, wherein the sparger assembly comprises a cylindrical member having a plurality of openings located therein such that the flow of fluid thereto is received into an end of the cylindrical member and directed through the openings and outside the cylindrical member.

12. The economizer inlet mixing device of claim 10, further includes a pump protection strainer located at the outlet.

13. The economizer inlet mixing device of claim 10, wherein the wave breaker assembly is located at a downcomer nozzle.

14. The economizer inlet mixing device of claim 10, wherein the plurality of baffles are longitudinally arranged in a conduit.

* * * * *